US008112819B2

(12) United States Patent
Larson et al.

(10) Patent No.: US 8,112,819 B2
(45) Date of Patent: Feb. 14, 2012

(54) THREE-DIMENSIONAL CAMOUFLAGE GARMENT

(75) Inventors: Ed Larson, Sidney, NE (US); Dale Douglas, Sidney, NE (US)

(73) Assignee: Cabela's Inc., Sidney, NE (US)

( * ) Notice: Subject to any disclaimer, the term of this patent is extended or adjusted under 35 U.S.C. 154(b) by 0 days.

(21) Appl. No.: 11/456,799

(22) Filed: Jul. 11, 2006

(65) Prior Publication Data

US 2008/0282440 A1 Nov. 20, 2008

Related U.S. Application Data

(60) Provisional application No. 60/698,509, filed on Jul. 11, 2005.

(51) Int. Cl.
*A41D 3/02* (2006.01)

(52) U.S. Cl. ..... 2/94

(58) Field of Classification Search ..... 2/900, 69, 2/1, 244, 252, 247, 84, 94, 101; 428/15, 428/17

See application file for complete search history.

(56) References Cited

U.S. PATENT DOCUMENTS 2,351,142 A * 6/1944 Mitchell ..... 428/136
3,069,796 A * 12/1962 Benisch et al. ..... 428/17
4,106,124 A * 8/1978 Green ..... 2/422
4,517,230 A * 5/1985 Crawford ..... 428/17
4,931,320 A * 6/1990 Leonard ..... 428/17
5,010,589 A * 4/1991 Hamilton ..... 2/1
5,013,375 A * 5/1991 Leonard ..... 156/61
D326,020 S * 5/1992 Kleinen ..... D5/18
5,274,848 A * 1/1994 Shamblin ..... 2/69
5,281,460 A * 1/1994 Cox ..... 428/112
5,347,659 A * 9/1994 Tibljas ..... 2/84
5,486,385 A * 1/1996 Bylund et al. ..... 428/17
5,695,835 A * 12/1997 Weber et al. ..... 428/17
6,127,007 A * 10/2000 Cox et al. ..... 428/15
6,460,185 B1 * 10/2002 Hardy ..... 2/69
6,500,214 B1 * 12/2002 Muirhead ..... 8/478
6,675,394 B2 * 1/2004 Egnew ..... 2/227
6,699,803 B2 * 3/2004 Muirhead ..... 442/2
D492,123 S * 6/2004 Collins ..... D5/7
6,754,910 B2 * 6/2004 Shultz et al. ..... 2/244
6,787,212 B2 * 9/2004 Strength et al. ..... 428/102
6,851,126 B1 * 2/2005 Humphreys ..... 2/69
6,910,223 B2 * 6/2005 Egnew ..... 2/69
6,991,690 B2 * 1/2006 Strength et al. ..... 156/61
7,036,154 B1 * 5/2006 McVay ..... 2/94
7,065,793 B1 * 6/2006 Wooten ..... 2/69
7,143,452 B1 * 12/2006 Rossini ..... 2/209.13
7,412,937 B2 * 8/2008 Stevens et al. ..... 112/475.08
7,415,934 B2 * 8/2008 Takken ..... 112/475.08
7,478,607 B2 * 1/2009 Bylsma et al. ..... 112/475.08
2002/0142112 A1 * 10/2002 Tarrell ..... 428/17
2003/0200599 A1 * 10/2003 Shultz et al. ..... 2/900

* cited by examiner

*Primary Examiner* — Alissa L Hoey
(74) *Attorney, Agent, or Firm* — K&L Gates LLP

(57) ABSTRACT

The present invention relates to a three-dimensional camouflage garment including a base fabric and fabric pieces attached thereto. The fabric pieces may be attached to the base fabric via substantially horizontal attachment lines. The fabric pieces may include a tab portion for attachment to the base fabric and a depending portion depending from the tab portion. As attached, the fabric pieces may include a non-flat orientation to facilitate the three-dimensional effect. Associated methods of producing a three-dimensional camouflage garment are also provided.

8 Claims, 5 Drawing Sheets

THREE-DIMENSIONAL CAMOUFLAGE GARMENT

CROSS REFERENCE TO RELATED APPLICATION

This application claims priority to U.S. Provisional Patent Application Ser. No. 60/698,509 filed Jul. 11, 2005, entitled "THREE-DIMENSIONAL CAMOUFLAGE GARMENT WITH HORIZONTAL ROWS," the contents of which are incorporated herein by reference in their entirety.

BACKGROUND OF THE INVENTION

Camouflage garments have long been used by soldiers, hunters and other outdoorsmen. Originally, such fabrics included a coloring selected to make the wearer hard to distinguish from his surroundings. In that regard, camouflage fabrics often include colorings in greens and browns for forest areas or beige/brown for drier surroundings. An early improvement in connection with camouflage garments involved the recognition that it is desirable to not merely match the coloring of the expected surroundings but also to obscure shapes. Accordingly, camouflage garments also typically contain a pattern that tends to obscure the outline of the wearer, enabling the wearer to move through various environments with reduced risk of detection.

More recently, it has been recognized that three-dimensional camouflage garments enhance the camouflage effect. In particular, a flat fabric, even if well colored to match the surroundings and patterned to obscure outlines of the wearer, may allow animals to detect the human outline. In turn, some manufacturers have begun to offer three-dimensional camouflage garments. Typically, these garments are manufactured by attaching fabric strips to a base garment to provide the three-dimensional effect. For example, strips of fabric may be sewed to the base garment along vertical stitch lines; that is, stitch lines that are generally parallel to the inseam seams of pants or side seams of jackets. One problem associated with the use of vertical stitch lines is that numerous stitch lines must be utilized if it is desired to cover a substantial portion of the base garment and/or fairly large sized fabric strips may be required. Moreover, attachment of the fabric strips via vertical stitch lines may not produce the desired three-dimensional effect as such attached fabric pieces may lie in an undesired position.

SUMMARY OF THE INVENTION

In view of the foregoing, one objective of the present invention is to produce a camouflage garment that more effectively breaks the human outline, for example, by providing a more realistic three-dimensional leaf drape. Another objective is to provide more complete coverage of the base fabric for a given spacing of the stitch lines and given size fabric strips. Another objective of the present invention is to orient the attached fabric pieces such that they may more readily lie in a desired position to further enhance the three-dimensional camouflage effect.

In this regard, it has been recognized that attaching such fabric strips along substantially horizontal attachment lines allows for better hanging of such fabric strips to enhance the desired three-dimensional camouflage effect. Moreover, it has been recognized that significant efficiencies can be achieved by forming multiple strips from a single piece of fabric that can be attached to a horizontal stitch line in a single stitching process.

More particularly, one or more of the above objectives and additional advantages may be realized by an inventive three-dimensional camouflage garment that includes a base fabric and a plurality of fabric strips attached to the base fabric via one or more attachment lines, wherein the attachment lines extend along the base fabric in a side-to-side fashion relative to a standing wearer of the garment. That is, the attachment lines extend horizontally or substantially horizontally across the base fabric relative to a standing wearer of the garment. Thus, the fabric strips may hang from the garment (e.g., droop) such that a more realistic and effective camouflage garment is achieved. Additionally, a larger portion of the garment is covered by the fabric strips relative to vertically attached fabric strips. In one approach, adjacent strips are attached to the base fabric in partially overlapping relation, thereby providing an enhanced three-dimensional camouflage effect. Moreover, a plurality of fabric strips may be formed from a single piece of fabric and attached to the base fabric via a single attachment line, thereby simplifying manufacturing.

As may be appreciated, the base fabric generally defines a portion of the garment and includes a top end, a bottom end and sides relative to a standing wearer of the garment. The base fabric may be any environment appropriate fabric (e.g., a waterproof fabric for use in wet environments or a thick fabric for use in cold environments) and may include any coloring scheme and/or pattern suitable to facilitate the three-dimensional camouflage effect. The fabric strips may also include any coloring and/or shape for the purpose thereof. In one embodiment, the fabric strips are curved. In another embodiment, the fabric pieces mimic foliage. However, the strips may be of substantially any shape.

In a particular arrangement of the present invention, the fabric strips are attached to the base fabric in a non-flat configuration. In this regard, the fabric strips may be attached to the base fabric via one or more attachment lines, where the fabric strips are folded or allowed to pucker prior to attachment to the base fabric, and wherein the fabric strips are then stitched to the base fabric to provide the non-flat orientation. In this regard, the fabric strips may include a depending portion and a tabbed portion, where the fabric strips are attached to the base fabric via the tabbed portion with the depending portions hanging freely. In one embodiment, the depending portion extends downwardly toward (e.g., hangs down toward, droops toward, etc.) the bottom end of the base fabric. In this regard, the depending portion may extend directly downward or may first extend upwardly from the stitch line before drooping downward (e.g., to enhance the three-dimensional effect or "loft" of the fabric).

In a particular arrangement, the plurality of fabric strips may include a first fabric strip and a second fabric strip, and the attachment lines may include a first attachment line and a second attachment line. The first fabric strip may be attached to the base fabric via the first attachment line and the second fabric strip may be attached to the base fabric via the second attachment line. In one embodiment, the second attachment line is disposed downwardly of the first attachment line relative to the base fabric. In a particular embodiment, the first fabric strip and second fabric strip may be attached to the base fabric in overlapping relation. In one embodiment, the first fabric strip may include the above-noted tabbed and depending portions, where the first fabric piece is attached to the base fabric via the tabbed portion. In this embodiment, the depending portion may extend downwardly toward the bottom end of the base fabric. In turn, the depending portion may include a bottom end wherein the second attachment line is disposed between the bottom end of the depending portion of the first fabric strip and the first attachment line. That is, the second attachment line is between the bottom end of the first fabric strip and the first attachment line. In one arrangement, the first and second attachment lines may extend along the base fabric in a substantially horizontal direction relative to the base fabric.

The present invention also contemplates methods for forming three-dimensional camouflage garments. In a particular approach, the method includes the steps of cutting a number of fabric pieces in one or more desired strip shapes and attaching at least one of these fabric pieces to a base fabric along a substantially horizontal attachment line. In one approach, the cutting step includes laser cutting of the camouflage fabric. At least one of the fabric pieces may be cut to define multiple depending strips. The method may further include the step of folding at least one of the fabric pieces, such as before the attaching step, to facilitate production of non-flat fabric pieces.

DETAILED DESCRIPTION OF THE INVENTION

Reference will now be made to the accompanying drawings, which at least assist in illustrating the various pertinent features of the present invention. In this regard, the following description of a three-dimensional camouflage garment is presented for purposes of illustration and description. Furthermore, the description is not intended to limit the invention to the form disclosed herein. Consequently, variations and modifications commensurate with the following teachings, and skill and knowledge of the relevant art, are within the scope of the present invention.

Figure 1:
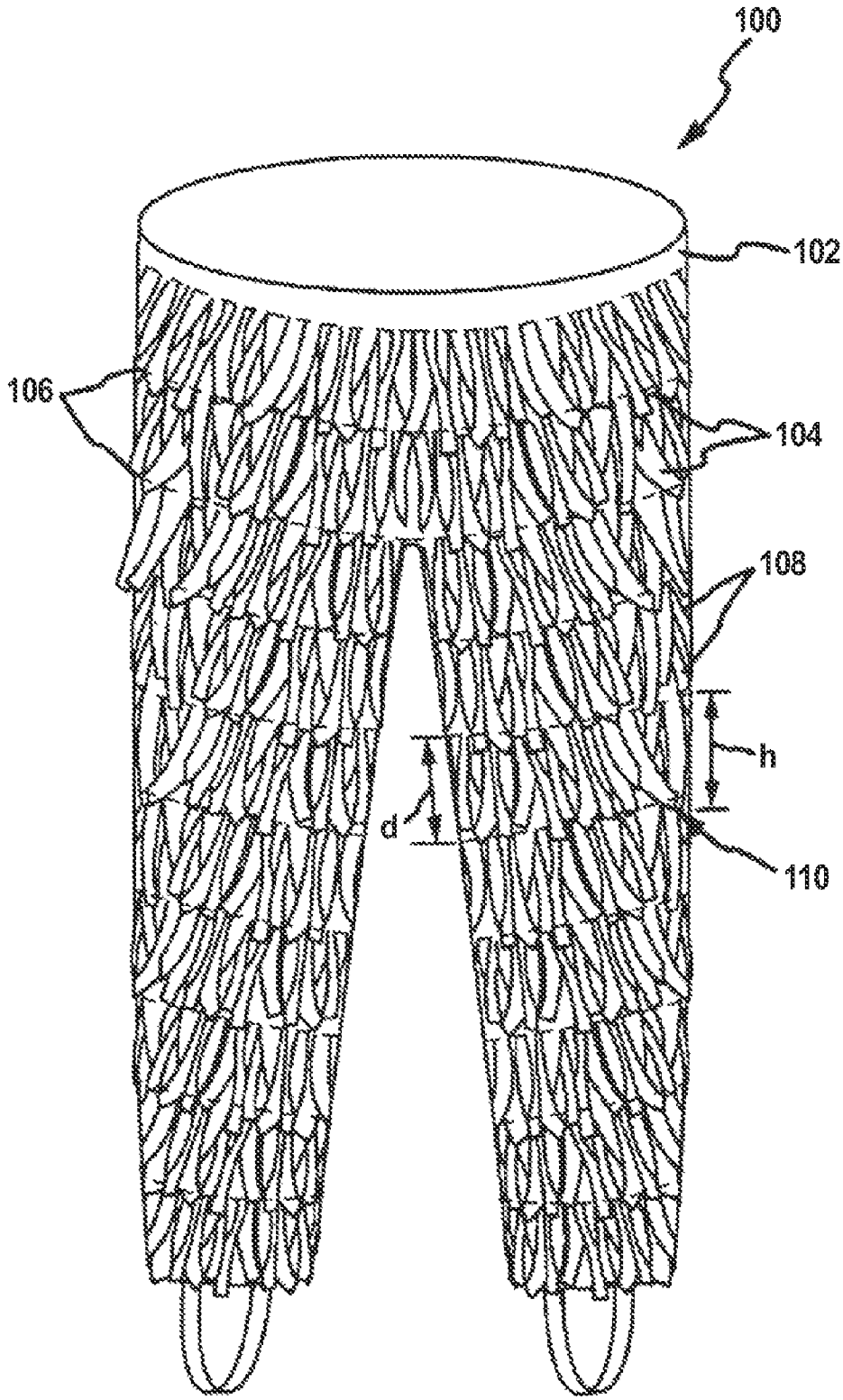
FIG. 1 is a perspective view of one embodiment of a three-dimensional camouflage garment in accordance with the present invention.

One embodiment of a three-dimensional camouflage garment in accordance with the present invention is illustrated in FIG. 1. The garment 100 includes a base fabric 102 and a number of fabric pieces 104 attached to the base fabric 102. The fabric pieces are attached to the base fabric 102 along a number of attachment lines 106. In the illustrated embodiment, the attachment lines 106 are substantially horizontal relative to the base fabric 102. That is, when a wearer of the garment 100 is standing, the attachment lines 106 are substantially horizontal. Thus, the fabric pieces 104 may hang from the base fabric 102 in a substantially downward direction, thereby enhancing the desired camouflage effect and provide a more natural appearing layering.

The base fabric 102 may include any desired color scheme to facilitate the desired three-dimensional camouflage effect. In one embodiment, at least the outer surface of the base fabric 102, or a surface that is otherwise visible from the exterior, is formed with an appropriate camouflage coloring and/or pattern.

The base fabric 102 may be any fabric or material to which the fabric pieces 104 may be attached. For example, the base fabric 102 may be formed from a breathable nylon mesh to facilitate heat and vapor exchange for additional comfort. The base fabric 102 may be formed from cotton or other material that allows for quiet movement. The base fabric 102 may be selected to resist or prevent bites by mosquitoes or other bugs. The base fabric 102 may be formed from a waterproof and/or insulated fabric or layers thereof to provide the desired thermal and waterproofing qualities.

The fabric pieces 104 may be of any suitable form and/or color scheme to facilitate the desired three-dimensional camouflage effect. In the embodiment of FIG. 1, the fabric pieces 104 are provided in the form of fabric strips preferably having a curved shape so as to avoid unnaturally uniform lines, though straight strips may be utilized in accordance with the present invention. Furthermore, the fabric pieces 104 may be formed from any appropriate material, such as, for example, polyester and/or cotton fabric. As may be appreciated, the size of the fabric pieces 104 and/or their spacing can be varied.

The fabric pieces 104 may comprise any suitable color scheme that facilitates the desired three-dimensional camouflage effect. For example, the fabric pieces 104 may include a solid color or may include camouflage coloring and/or patterns. In this regard, it may be desired to provide a slight mismatch or complementary offset between the camouflage coloring and/or patterning of the fabric pieces 104 in relation to the base fabric 102. For example, the coloring of the base fabric 102 may be slightly darker than that of the fabric pieces 104 so as to create the illusion of shadowing and filtered lighting.

The fabric pieces 104 may include a depending portion 108 extending from an attachment line 106 to a distal end 1 10. In the illustrated embodiment, the depending portion 108 has a height of "h", measured from the attachment line 106 to the distal end 110, that is at least as great as a distance ("d") between adjacent attachment lines 106. In this manner, the fabric pieces 104 attached at adjacent attachment lines 106 overlap to enhance the three-dimensional effect and provide a more natural appearing layering. In one embodiment and as discussed in further detail below, the fabric pieces may be folded or puckered prior to or concurrent with attachment to the garment so that the attached fabric pieces 104 do not lie flat.

As may be appreciated, the three-dimensional camouflage garment 100 may be provided in connection with a variety of garments or articles where a camouflage effect is desired. Although the garment 100 is illustrated in the form of pants, it will be appreciated that the garment 100 may be provided in the form of a vest, jacket or other covering for the upper torso of a wearer, in the form of a bib, jumpsuit, coverall or other covering for the body of the wearer, or in any other suitable form. As may be appreciated, the garment 100 may be sized appropriately.

In order to enhance the three-dimensional texturing of the fabric pieces 104 when attached to the base fabric 102, it may be desirable to attach the fabric pieces 104 in a folded, puckered, or otherwise unflat configuration. In one approach and with reference to FIGS. 2-3, the fabric pieces 104 may be folded (e.g., in an accordion style) prior to their attachment to the base fabric 102. In another approach, elastic materials may be utilized with the fabric pieces 104, where such elastic materials are expanded prior to attachment. After attachment of the fabric pieces 104 to the base fabric 102, the elastic materials may retract to pucker or otherwise orient the fabric pieces in an unflat orientation. Other techniques, such as heat-treating to induce shrinking, may also be utilized to facilitate an unflat appearance.

Figure 3:
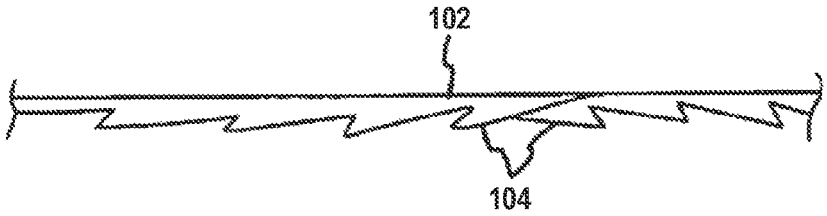
FIG. 3 is a top view of the embodiment of FIG. 2.

In the illustrated embodiment, the fabric pieces 104 are cut from flat material and are then folded accordion style, as best shown in FIG. 3, such that the fabric pieces 104 are prevented from laying flat on the base fabric 102. This process allows the fabric strips to lift off the base fabric for an enhanced three-dimensional effect or loft. The fabric pieces 104 are then attached to the base fabric 102 via attachment line 106, where at least a portion of the attachment line 106 extends through one or more accordion portions of a fabric piece 104 to provide the unflat orientation. In one embodiment, adjacent fabric pieces 104 on a single attachment line 106 overlap to provide a further degree of texturing.

Figure 2:
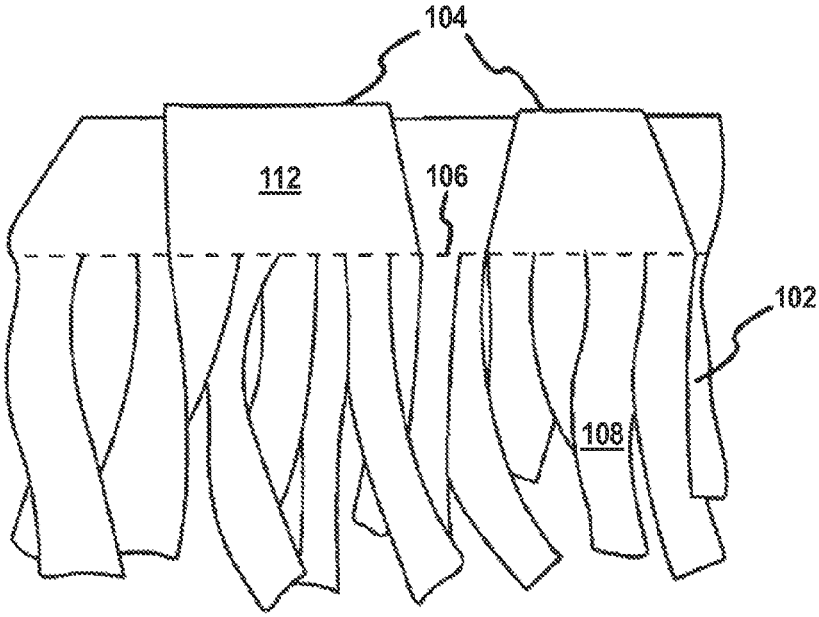
FIG. 2 is a front view of one embodiment of a fabric piece attached to a base fabric in accordance with the present invention.

As shown in FIGS. 2 and 3, a number of fabric pieces 104 are attached along a single attachment line 106. However, it will be appreciated that multiple attachment lines 106 may be employed. Moreover, each fabric piece 104 may include a depending portion 108 and/or an upper portion 112, which may be hemmed or formed as a free flap.

Figure 6:
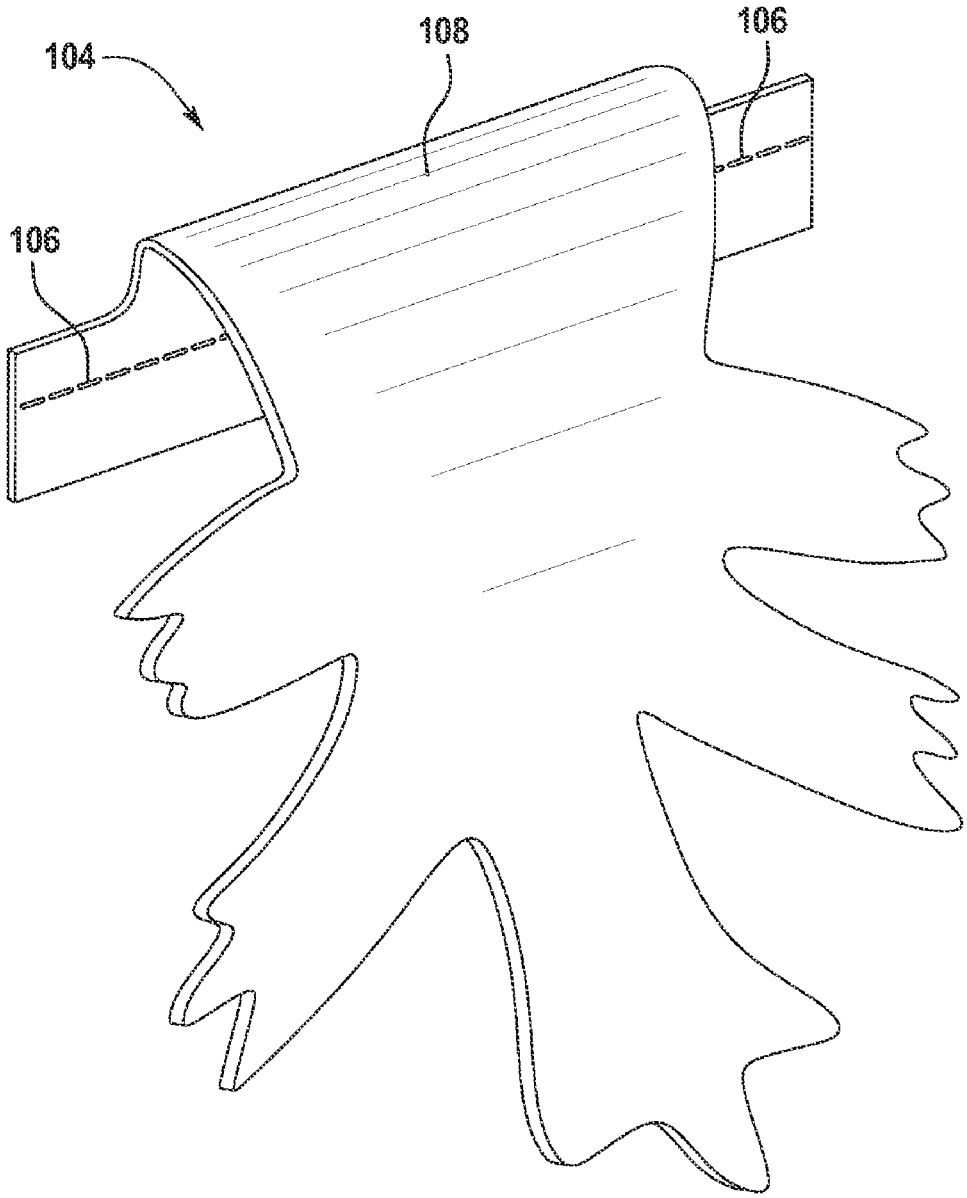

Although the fabric pieces 104 are illustrated as being attached so that the dependent portions 108 hang directly from the attachment line 106, it will be appreciated that the fabric pieces 104 may be inverted such that the depending portion 108 extends upwardly from the attachment line 106, immediately adjacent to the attachment line 106 and then falls downwardly or drapes from the attachment line 106 due to the effects of gravity, as illustrated at FIG. 6. In this manner, greater loft may be imparted to the fabric pieces 104, which may further enhance the three-dimensional effect. As shown, multiple fabric pieces 104 may be interconnected via a single upper portion 112, which greatly simplifies construction and attachment of the fabric pieces 104 (e.g., via a single stitch line).

As noted, the attachment lines 106 may be used to attach the fabric pieces 104 to the base fabric 102. In one embodiment, the attachment lines 106 are stitch lines that are stitched through the base fabric 102 and fabric pieces 104 to achieve the attachment. In another embodiment, the attachment lines 106 are adhesive lines that utilize an adhesive (e.g., a glue or paste) to attach the fabric pieces 104 to the base fabric. In another embodiment, the attachment lines 106 include a velcro-like material to enable the selective attachment and removal of fabric pieces 104 from the base fabric 102. Thus, in this embodiment, a user may be able to selectively define a three-dimensional camouflage garment arrangement.

Figure 4:
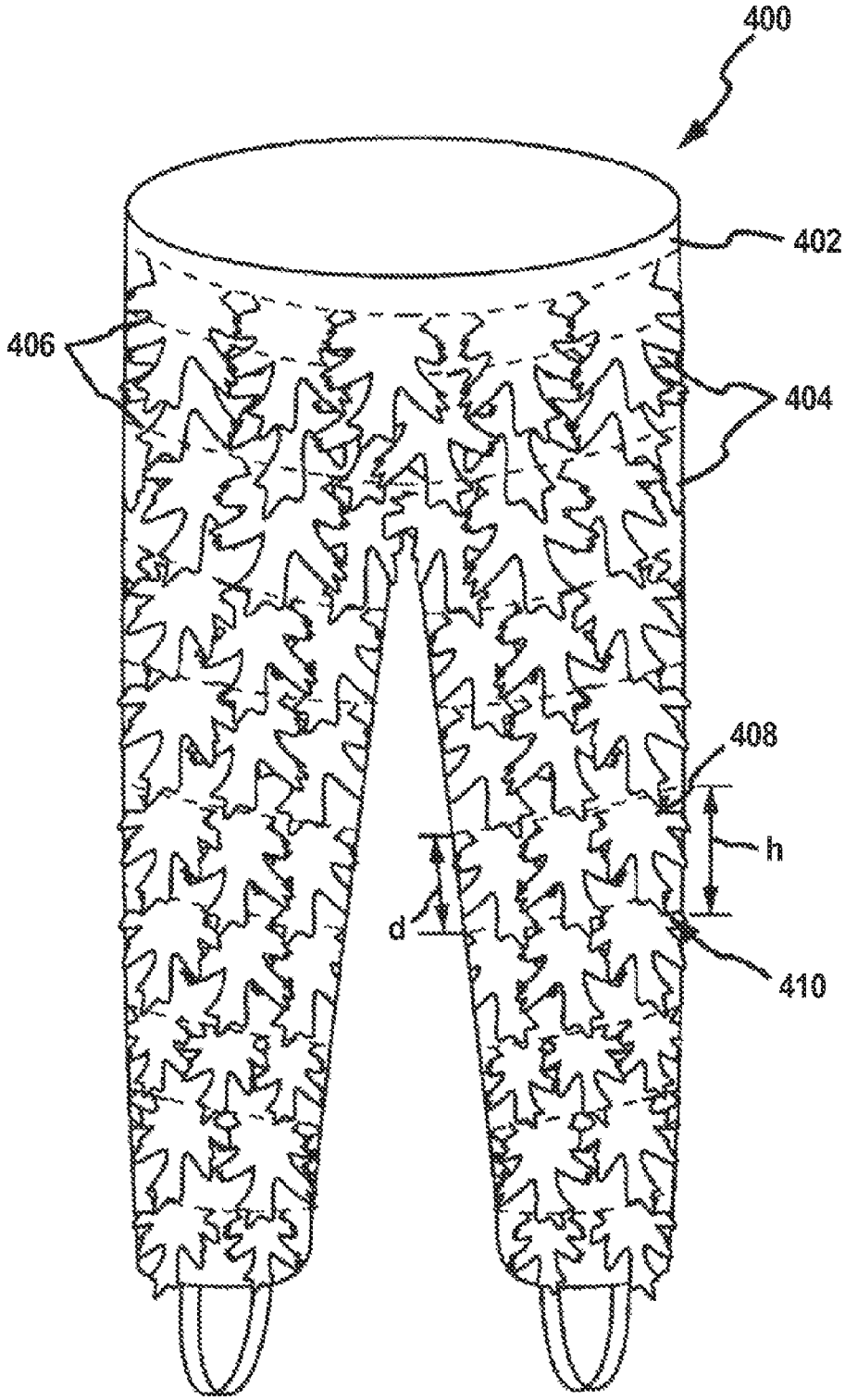
FIG. 4 is a perspective view of another embodiment of a three-dimensional camouflage garment in accordance with the present invention.

Another embodiment of a three-dimensional camouflage garment is illustrated in FIG. 4, where the fabric pieces 404 of the garment 400 are provided in the form of oak leaves, maple leaves, and other shapes designed to mimic foliage. It will be appreciated that other shapes are possible for the fabric pieces 404. Moreover, the embodiment of FIG. 4 may contain any of the features discussed above in relation to FIG. 1, such as a base fabric 402 to which the fabric pieces 404 are attached (e.g., via one or more attachment lines 406), a depending portion 408, a distal end 410 and an upper portion (not illustrated). The depending portion 408 may have a height of "h", measured from a attachment line 406 to a distal end 410, that is at least as great as a distance ("d") between adjacent attachment lines 406 so that adjacent fabric pieces 404 overlap to enhance the three-dimensional affect and provide a more natural appearing layering.

Figure 5:
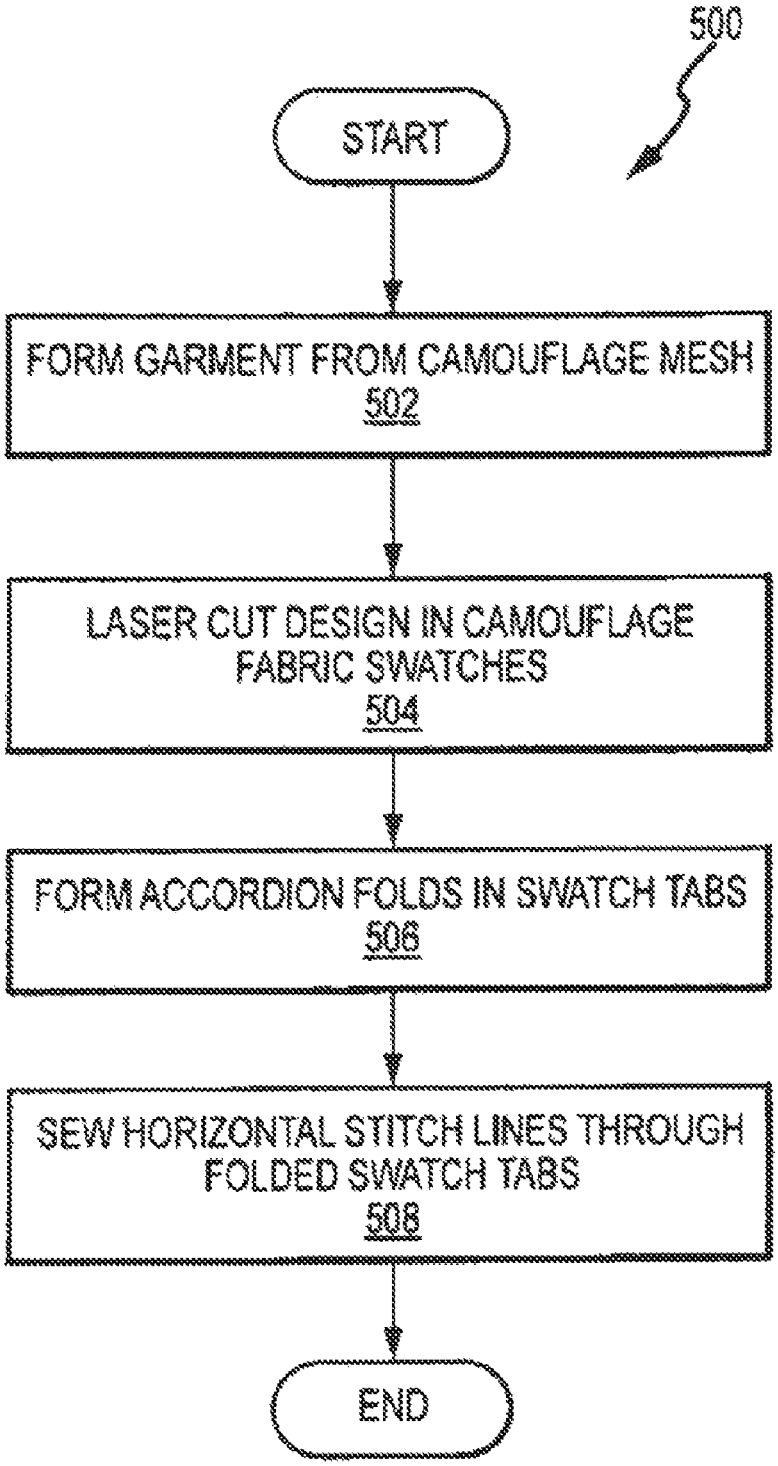
FIG. 5 is a flow chart illustrating one embodiment of manufacturing a three-dimensional camouflage garment in accordance with the present invention.

The present invention also contemplates a unique method of fabricating a three-dimensional camouflage garment. In this regard and with reference to FIG. 5, methods of forming a garment in accordance with the present invention are now described. The method 500 may be initiated by forming a camouflage fabric (502). One or more desired fabric piece designs may then be cut from the camouflage fabric (504). For example, as described above, the cut fabric pieces may mimic foliage or may be provided in the form of a number of fabric strips. Additionally, the fabric pieces may be cut in any appropriate manner, such as, for example, via laser cutting or the like, to facilitate formation of intricate patterns while providing for smooth edges that will resist fraying or tearing. Finally, the folded fabric pieces may be attached to a base fabric to form the three-dimensional camouflage garment (508). Optionally, these fabric pieces may be folded prior to attachment (506), as described above. It will be appreciated that the attachment lines need not be horizontal or substantially horizontal everywhere. For example, the attachment lines may slope to other orientations due to tailoring. Moreover, the fabric pieces need not cover the entire base fabric. For example, the fabric pieces may be omitted in the chest area to avoid entanglement with bow and arrow assemblies or in between the legs and arms to enhance quiet movement.

While various embodiments of the present invention have been described in detail, it is apparent that further modifications and adaptations of the invention will occur to those skilled in the art. However, it is to be expressly understood that such modifications and adaptations are within the spirit and scope of the present invention.

What is claimed is:

1. A camouflage garment configured to be worn by a standing wearer, the camouflage garment comprising:

a base fabric defining a portion of said garment, said portion covering one of a torso, separate from any garment sleeves, and leg section of said standing wearer, said base fabric having a top end, a bottom end and sides relative to the standing wearer; and a plurality of fabric pieces attached to said base fabric at an attachment line, the attachment line extending along said base fabric in a substantially horizontal direction relative to the standing wearer, wherein each of said plurality of fabric pieces includes a depending portion including a proximal section and a distal section, and an upper portion including a section extending below the attachment line when the standing wearer is wearing the garment, and each of the plurality of fabric pieces is attached to said base fabric via said upper portion such that a proximal section of said depending portion, proximate to said upper portion, extends upwardly above the attachment line towards said top end of said base fabric, and wherein the distal section of said depending portion extends downwardly beyond the attachment line toward said bottom end of said base fabric when the standing wearer is wearing the garment.

2. The camouflage garment of claim 1, wherein the attachment line is a first attachment line, and which includes a second attachment line, wherein the distal section extends distally toward said distal-bottom end of said base fabric and additionally beyond the second attachment line when the standing wearer is wearing the garment.

3. The camouflage garment of claim 1, wherein at least two of said plurality of fabric pieces are attached to said base fabric in partially overlapping relation.

4. The camouflage garment of claim 1, wherein said fabric pieces are curved.

5. The camouflage garment of claim 1, wherein at least one of said depending portions includes a plurality of elongated members that are substantially parallel to each other.

6. The camouflage garment of claim 5, wherein at least one of the elongated members extends generally perpendicular to the attachment line.

7. A camouflage garment configured to be worn by a standing wearer, the camouflage garment comprising:

a base fabric defining a portion of the garment, the base fabric including a top end, a bottom end and sides each relative to the standing wearer, and an attachment line extending along the base fabric in a substantially horizontal direction relative to the standing wearer of the garment; and a plurality of fabric pieces each including an upper portion attached to the base fabric at the attachment line, the upper portion including a section extending below the attachment line when the standing wearer is wearing the garment, and a depending portion having a proximal section and a distal section, the proximal section extending upwardly above the attachment line towards the top end of the base fabric and the depending portion extending downwardly beyond the attachment line toward the bottom end of the base fabric when the standing wearer is wearing the garment.

8. A camouflage garment configured to be worn by a standing wearer, the camouflage garment comprising:

a base fabric defining a portion of the garment, the base fabric including a top end, a bottom end and sides relative to the standing wearer of the garment, a first attachment line extending along the base fabric in a substantially horizontal direction relative to the standing wearer, and a second attachment line spaced apart from the first attachment line and extending along the base fabric in a substantially horizontal direction relative to the standing wearer; and a plurality of first fabric pieces each including an upper portion attached at the first attachment line, the upper portion including a section extending below the first attachment line when the standing wearer is wearing the garment, and a depending portion having a proximal section and a distal section, the proximal section extending upwardly above the first attachment line towards the top end of the base fabric and the distal section extending downwardly beyond the first and second attachment lines toward the end of the base fabric when the standing wearer is wearing the garment; and a plurality of second fabric pieces each including an upper portion attached at the second attachment line, the upper portion including a section extending below the second attachment line when the standing wearer is wearing the garment, and a depending portion having a proximal section and a distal section, the proximal section extending upwardly above the second attachment line towards the top end of the base fabric and the distal section extending downwardly beyond the second attachment line toward the bottom end of the base fabric when the standing wearer is wearing the garment.

* * * * *